US005539636A

United States Patent [19]

Marsh et al.

[11] Patent Number: 5,539,636

[45] Date of Patent: Jul. 23, 1996

[54] SURFACE BLASTING SYSTEM

[75] Inventors: Michael J. C. Marsh, Johannesburg; Trevor M. Hodson, Randburg; James P. Tolmay, Pretoria; Jan G. Pieterse, Pretoria; Annemarie Van Den Doel, Pretoria, all of South Africa

[73] Assignee: CSIR, Pretoria Transvaal, South Africa

[21] Appl. No.: 162,471

[22] Filed: Dec. 7, 1993

[30] Foreign Application Priority Data

Dec. 7, 1992 [ZA] South Africa ..... 92/9471

[51] Int. Cl.[6] ..... G06F 19/00

[52] U.S. Cl. ..... 364/421

[58] Field of Search ..... 364/420, 421, 364/422; 102/200, 202.1, 202.2, 206, 215, 217, 218, 221, 276, 301, 310, 311, 312

[56] References Cited

U.S. PATENT DOCUMENTS

| | | | |
|---|---|---|---|
| Re. 32,888 | 3/1989 | Kirby et al. . | |
| 4,884,506 | 12/1989 | Guerreri | 102/200 |
| 4,986,183 | 1/1991 | Jacob et al. . | |
| 5,117,756 | 6/1992 | Goffin, II . | |
| 5,214,236 | 5/1993 | Murphy et al. | 102/217 |
| 5,339,741 | 8/1994 | Craven et al. | 102/206 |

FOREIGN PATENT DOCUMENTS

| | | |
|---|---|---|
| 0420673A2 | 4/1991 | European Pat. Off. . |
| WO92/08932 | 5/1992 | WIPO . |

*Primary Examiner*—Donald E. McElheny, Jr.
*Attorney, Agent, or Firm*—Lowe, Price, LeBlanc & Becker

[57] ABSTRACT

Apparatus is provided for activating a plurality of groups of electrical loads, such as electrical detonators used in blasting, after respective time delays. The apparatus comprises a master control unit which generates master control signals to initiate timing out of delay devices associated with each load. The apparatus further includes several auxiliary control units which are connectable to the master control unit. Each auxiliary control unit is adapted to control a respective group of remote electrical delay devices with associated electrical loads. Each auxiliary control unit includes local control means for generating local control signals from the master control signals which are synchronised with the local control signals of other auxiliary control units, for initiating operation of the delay devices, so that a large blast can be carried out in a perfectly synchronised manner. The master control unit may transmit master programming signals to the auxiliary control units, which each program the electrical delay devices of their respective group. Synchronisation of the local control signals can be achieved in a number of different ways. A method of activating a plurality of groups of electrical loads is also described.

20 Claims, 13 Drawing Sheets

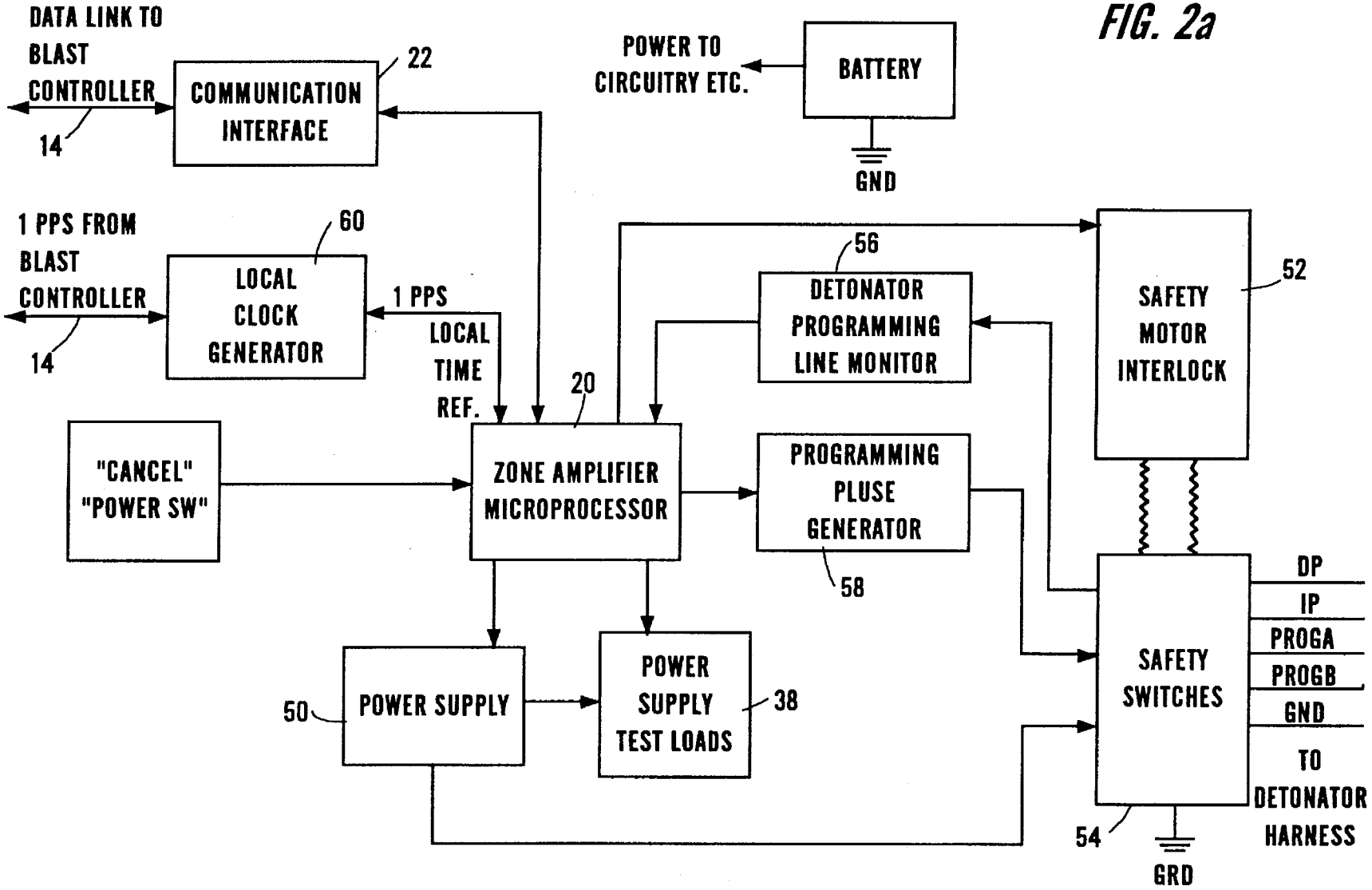
FIG. 2a
SAFETY MOTOR INTERLOCK
52
SAFETY SWITCHES
54
DP
IP
PROGA
PROGB
GND
TO DETONATOR HARNESS
GRD
BATTERY
GND
POWER TO CIRCUITRY ETC.
DETONATOR PROGRAMMING LINE MONITOR
56
PROGRAMMING PLUSE GENERATOR
58
POWER SUPPLY TEST LOADS
38
ZONE AMPLIFIER MICROPROCESSOR
20
POWER SUPPLY
50
COMMUNICATION INTERFACE
22
LOCAL CLOCK GENERATOR
60
1 PPS
LOCAL TIME REF.
"CANCEL" "POWER SW"
DATA LINK TO BLAST CONTROLLER
14
1 PPS FROM BLAST CONTROLLER
14

SURFACE BLASTING SYSTEM

BACKGROUND OF THE INVENTION

This invention relates to a method of and an apparatus for activating a plurality of groups of electrical loads such as electrically activated detonators. The invention has particular application in surface blasting techniques.

When carrying out a blasting operation on the surface of, for example, a quarry, the area of the blast may be very large. For example, an area of 500 m by 60 m (30 000 $m^2$) may be covered. This area may have, say, 300 holes, with multiple detonators per hole if the decking principle is used.

If electronically controlled detonators are used, the total length of the harness wires required to control the blast may be several kilometers. This can cause problems in powering and synchronizing all of the delay devices. Given the fact that the value of the explosive used in such a large blast may be of the order of several hundred thousand rand, it is very important to maintain timing accuracy when carrying out such blasts. It is also important to maintain safety standards in such blasts.

SUMMARY OF THE INVENTION

According to the invention apparatus for activating a plurality of groups of electrical loads after respective predetermined time delays comprises:

a master control unit for generating master control signals corresponding to an initiation instruction for a plurality of electrical delay devices associated with respective loads of each group of electrical loads; and a plurality of auxiliary control units connectable to the master control unit and each adapted to control a respective group of remote electrical delay devices which are associated with corresponding electrical loads, each auxiliary control unit including local control means for generating local control signals from the master control signals which are synchronised with local control signals of other auxiliary control units, for initiating operation of the electrical delay devices of the respective group of electrical loads, and energisation means adapted to supply electrical power to the electrical delay devices and corresponding electrical loads.

The master control unit may be adapted to generate master programming signals corresponding to an activation sequence for the electrical loads of each group of electrical loads and to transmit the master programming signals to respective auxiliary control units, each auxiliary control unit including processor means responsive to the master programming signals to generate local programming signals to program the operation of the respective group of electrical delay devices in accordance with the activation sequence.

The master control unit may be adapted to generate a master timing signal and to transmit the master timing signal to each auxiliary control unit, each auxiliary control unit including synchronisation means for generating local timing signals in synchronisation with the master timing signal, the local control signals of each auxiliary control unit being generated synchronously with the respective local timing signals.

The electrical loads may be electrically activated detonators, each with an associated electrical delay device.

The master control unit may comprise master processor means for generating a blast pattern, a plurality of communications interfaces for communicating with the respective auxiliary control units, and reference timing means for generating a master timing signal.

Each auxiliary control unit may include an auxiliary communication interface for receiving the master control signals from the central control unit and for transmitting data representative of the operational state of the auxiliary control unit to the master control unit.

In a preferred embodiment of the invention, the synchronisation means of each auxiliary control unit comprises a local oscillator for generating a primary local clock signal at a frequency higher than that of the master timing signal, frequency adjustment means for incrementally increasing or decreasing the frequency of the primary local clock signal in response to correction signals, frequency divider means for reducing the frequency of the primary local clock signal to a frequency close to that of the master timing signal, and comparator means for comparing the output of the frequency divider with the master timing signal and for generating correction signals which are applied to the frequency adjustment means so that the output frequency of the frequency divider means approaches that of the master timing signal.

Preferably, the frequency adjustment means comprises a multiplexer, a pulse adder circuit connected between the local oscillator and a first input connected between the local oscillator and a first input of the multiplexer, and a pulse subtracter circuit connected between the local oscillator and a second input of the multiplexer, with the output of the local oscillator being connected directly to a third output of the multiplexer, one of the first, second and third inputs of the multiplexer being selected in response to the correction signals to adjust the frequency of the primary local clock signal at an output of the multiplexer incrementally.

The synchronisation means of each auxiliary control unit may be arranged to generate the local timing signals, which have been synchronised with the master timing signal, independently of the master timing signal for a predetermined period prior to activation of the respective electrical loads.

Preferably, the master control unit is adapted to receive data corresponding to the activation sequence for the loads of all of the groups of electrical loads from an auxiliary computer, and to transfer data corresponding to the activation sequence for the loads of each group of electrical loads to the respective auxiliary control unit.

The master control unit may be adapted to receive data from each auxiliary control unit corresponding to the operational status thereof, and to transfer the received data to the auxiliary computer so that the status of each auxiliary control unit can be monitored centrally.

Further according to the invention a method of activating a plurality of groups of electrical loads after respective predetermined time delays, the method comprises:

generating master control signals at a master control unit corresponding to an initiation instruction for a plurality of electrical delay devices associated with respective loads of each group of electrical loads;

transmitting respective master control signals from the master control unit to each auxiliary control unit;

generating local control signals at each auxiliary control unit from the master control signals, the local control signals being synchronised with one another, for initiating operation of the electrical delay devices of the respective group of electrical loads; and energising the programmed delay devices and their associated loads to activate the loads.

The method may include transmitting master programming signals corresponding to an activation sequence for the electrical loads of each group of electrical loads from the master control unit to each auxiliary control unit, generating local programming signals therefrom, and transmitting the local programming signals to the electrical delay devices associated with each electrical load, thereby to program the operation of each electrical delay device and its associated load.

The method may include generating local timing signals at each of the auxiliary control units which are synchronized with the local timing signals of other auxiliary control units, and generating the local control signals synchronously with the respective local timing signals.

The method may include generating a master timing signal at the master control unit, transmitting the master timing signal to each auxiliary control unit, and generating the local timing signals in synchronisation with the master timing signal.

The master control signals may be generated in accordance with a blast pattern which is configured on a computer.

Preferably, the method includes laying out the blast pattern graphically on a display of the computer.

The method may include programming each delay device with a respective delay time.

The delay times for respective delay devices may be programmed automatically, using a stored timing pattern.

The programmed delay times may be adjusted in accordance with a chosen blast parameter to optimise that parameter.

BRIEF DESCRIPTION OF THE DRAWINGS

FIG. 2*a* is a schematic block diagram of an auxiliary control unit according to the invention;

DESCRIPTION OF EMBODIMENTS

Figure 1:
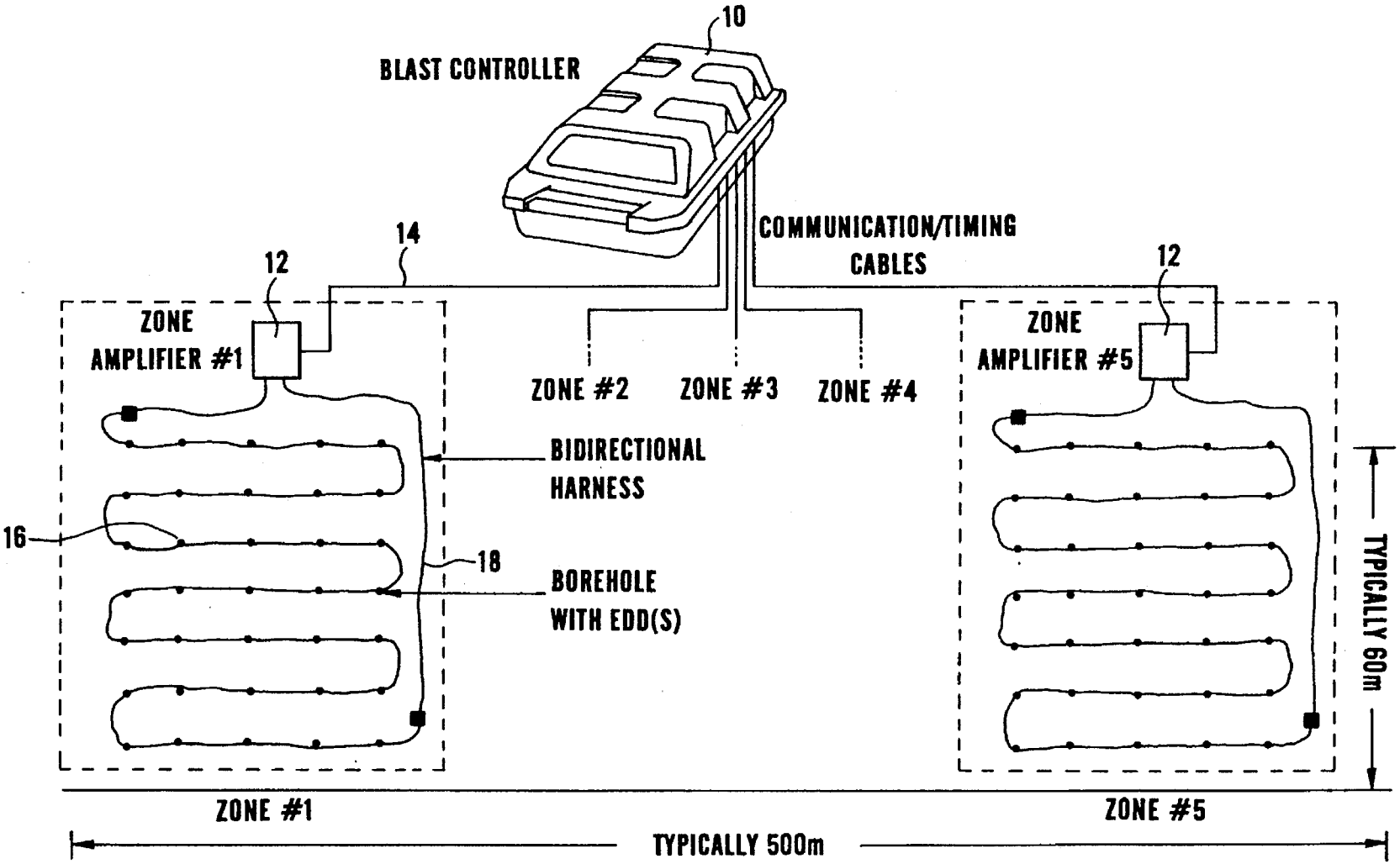
FIG. 1 is a schematic diagram of a distributed blasting system according to the invention.

The schematic diagram of FIG. 1 illustrates a distributed blasting system in which a master control unit (or blast controller) 10 controls five separate auxiliary control units 12 (referred to as "zone amplifiers" in FIG. 1) via communication/timing cables 14. Each auxiliary control unit 12 controls a number of electronic delay detonators (EDD's) 16 in respective boreholes, via a bidirectional harness 18. The detonators are programmed via the harness using the techniques described in South African patent application number 90/7794, the contents of which are incorporated herein by reference.

In the illustrated example, the entire blasting area is a rectangle approximately 500 m by 60 m, with each blasting zone being approximately 100 m by 60 m in size.

FIG. 2*a* is a block diagram showing the basic configuration of an auxiliary control unit (or zone amplifier) 12. The auxiliary control unit is similar to the controller illustrated in FIG. 2 of South African patent application no. 90/7794. The auxiliary control unit is based around a microprocessor 20, and includes a communication interface 22 and a local clock generator circuit 60 which receive control signals and master timing reference or clock signals, respectively, via a communication/timing cable 14 from the master control unit. The functioning of the auxiliary control unit is similar to that of the controller described in South African patent application no. 90/7794. However, an additional power supply test load section 38 is provided to enable the detonator power supply 50 to be fully functionally tested before use. This is very important in a distributed blasting system of the kind described, since the failure of one of the auxiliary control units would cause an overall failure of the blast. The microprocessor 20 also controls a safety motor interlock 52, which in turn controls safety switches 54. This ensures that this system is operating and that the lines to the detonators are all shorted to ground and to each other when the system is being connected up initially. The auxiliary control unit includes a detonator programming line monitor 56 and a programming pulse generator 58. These circuits, together with the safety motor interlock 52 and the safety switches 54, are described in the abovementioned patent application.

Figure 2B:
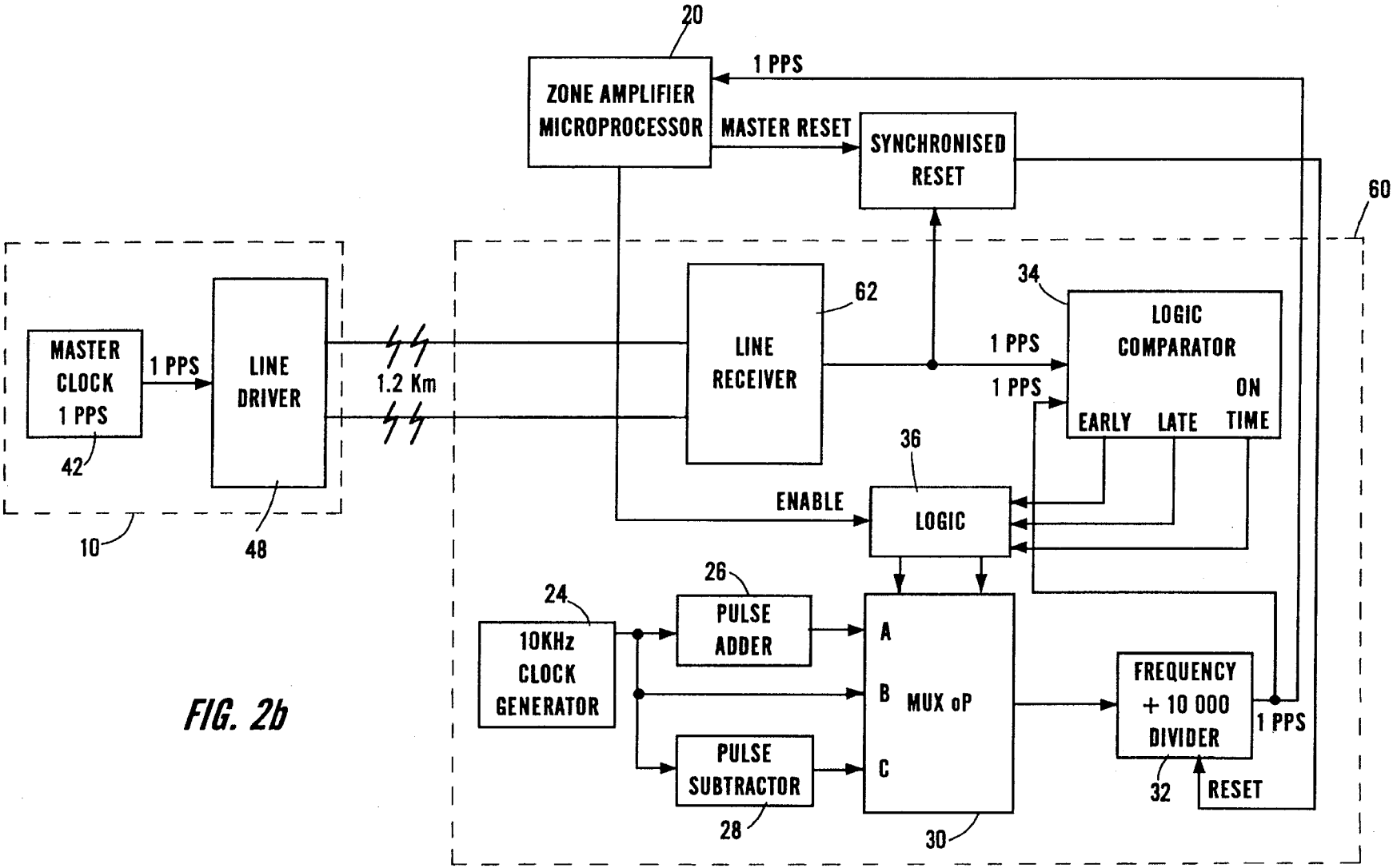
FIG. 2*b* is a schematic block diagram of timing synchronisation circuitry of the auxiliary control unit.

FIG. 2*b* is a schematic block diagram of the timing synchronisation circuitry of the auxiliary control unit (or zone amplifier) 12, which comprises mainly the local clock generator circuit 60 and the microprocessor 20.

The local clock generator circuit 60 includes a line receiver 62 and a time synchronisation circuit with its own local oscillator or clock generator 24. The local oscillator 24 is a stable, crystal controlled oscillator which runs at 10 kHz, and its output, which can be regarded as a "raw" or primary clock waveform, is fed to a pulse adder 26 and a pulse subtractor 28, the outputs of which are fed, together with the clock signal itself, to three inputs of a multiplexer 30. The pulse adder and subtractor add or subtract one pulse per second to the output of the clock generator 24. The output of the multiplexer is fed to a frequency divider 32, which divides the 10 kHz signal by a factor 10 000, to provide a 1 Hz (1 pulse per second) output. A logic comparator circuit 34 compares the locally generated 1 Hz signal with a 1 Hz master timing signal received from the master control unit 10 via the cable 14 and the line receiver 62, and generates correction signals which are fed to a logic circuit 36. This circuit selects one of the three multiplexer inputs, depending on whether the local clock signal is early, on time, or delayed with respect to the master clock signal. If correction is required, the frequency of the local clock signal is thus adjusted incrementally so that the output of the frequency divider 32 tends towards the master clock signal, until synchronisation is achieved.

The above described time synchronisation circuit is substantially noise immune, in that the adjustments made when synchronising the local clock square wave to the master clock square wave are done in very small steps, so that any noise spikes cannot suddenly cause the synchronisation to change. Once blasting begins, noise may be generated on the timing cables. For this reason, the synchronisation process is stopped when (or just before) blasting commences, and each auxiliary control unit runs on its own clock or timing signal, as most recently synchronised with the master timing signal from the master control unit. Since the local square wave oscillator 24 of each auxiliary control unit is crystal controlled, it maintains the necessary accuracy over the required (relatively short) period until the blast occurs.

The above described time synchronisation circuit ensures that each of the auxiliary control units synchronises its local clock signal to the master clock signal of the master control unit, by effectively adjusting the local clock signal until it matches the received master clock signal within a predetermined tolerance. However, other ways of synchronising the operation of the different auxiliary control units are possible. For example, the master control unit and the auxiliary control units can each be fitted with real time clocks. These clocks are all set to exactly the same time prior to the setting up of a blast. To carry out the blast, the auxiliary control units are instructed by the master control units to initiate their respective groups of detonators at a specific time. This system relies on the accuracy of the real time clocks, and does not require a comparison and feedback process such as that carried out by the above described time synchronisation circuitry. Factors which would influence the choice of synchronisation system would include the cost of the relevant components and the degree of accuracy achievable, according to the specific application.

Another approach which can be followed to achieve synchronisation between the operation of the different auxiliary control units is to arrange for the master control unit to send respective accurately synchronised control signals to each of the auxiliary control units, and for the auxiliary control units to be designed to introduce a negligible or at least a uniform time delay in initiating the operation of each respective group of electrical loads. In such an arrangement, the cables between the master control unit and each auxiliary control unit should be identical, to ensure that any delays introduced by the cables would be the same for each auxiliary control unit. In a variation of this approach, a very high speed communication medium such as optical fiber cables or radio transmitters/receivers could be provided between the master control units and the auxiliary control units, so that timing differences due to different distances between the master control unit and various auxiliary control units would be negligible.

The above described auxiliary control unit has fewer controls compared with the original controller of the above-mentioned patent application, and these comprise only a "cancel" switch and a power switch. However, all other features and functions of the original controller are attained, including its safety measures.

Figure 3:
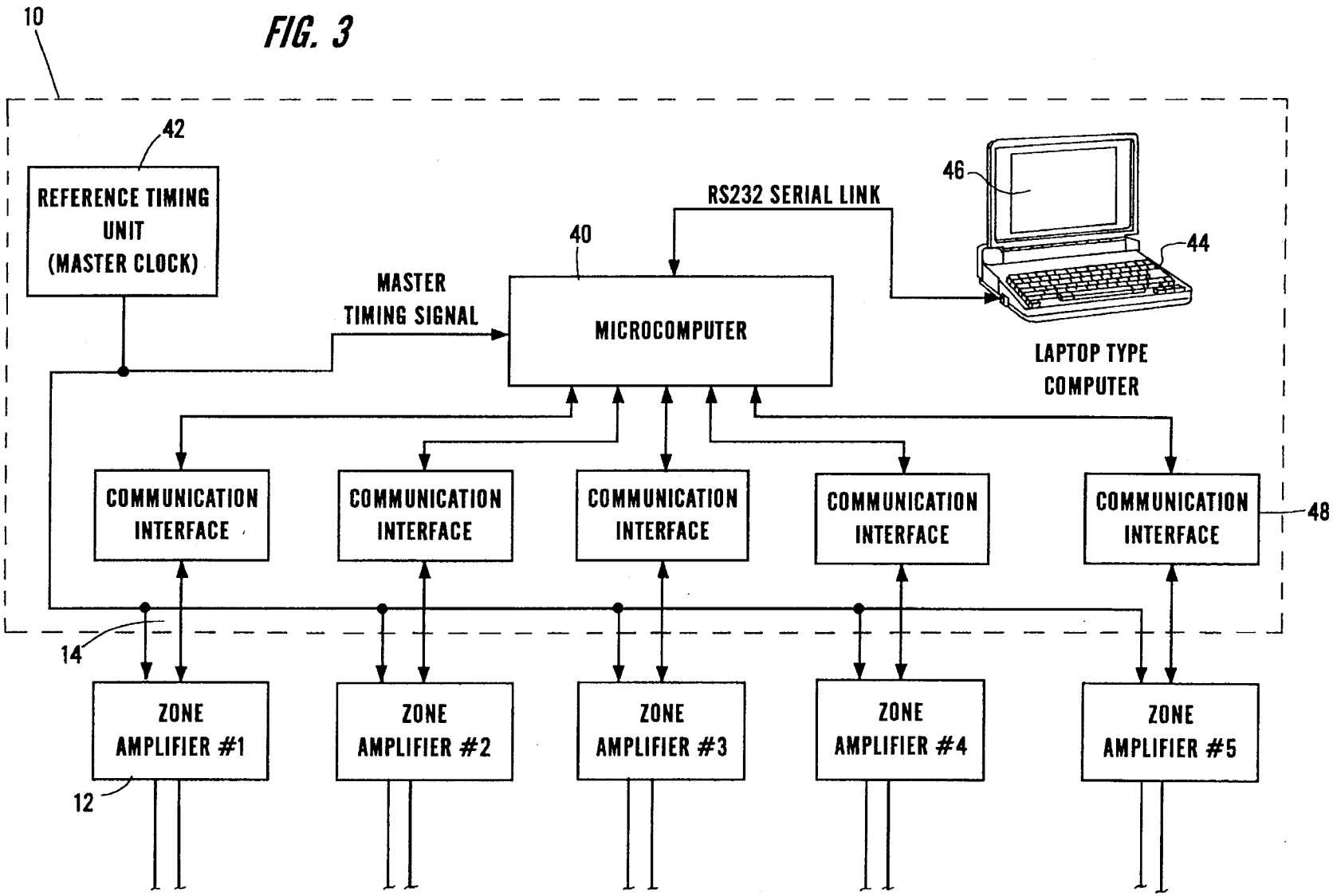
FIG. 3 is a simplified block diagram of a central control unit according to the invention.

FIG. 3 shows the general configuration of the master control unit or blast controller 10. This unit comprises a master microcomputer 40 and a reference timing unit (or master clock) 42 for generating reference or master timing signals which are transmitted to the auxiliary control units via five communication interface circuits 48, each incorporating a line driver for communicating with a respective auxiliary control unit 12. The master control unit also includes a laptop computer 44 with a display 46 for the entry of data and instructions. The computer 44 can be used by an operator to plan the blast layout, to simulate the results of the blast, to test the overall system and the electronic delay devices, and to initiate the blast.

The laptop computer communicates with the microcomputer 40 via an RS232 serial link. The microcomputer 40 in turn communicates with the auxiliary control units 12 via the respective communication interfaces 48 and the cables 14. The various blasting commands and the blasting pattern tables generated by the software in the laptop computer are transferred to the microcomputer 40, which in turn transfers the relevant commands and tables to the respective auxiliary control units (zone amplifiers) 12. The same information may be sent to each auxiliary control unit 12, or each auxiliary control unit may receive specific instructions which are unique to a particular blasting zone.

The communication interfaces of the master control unit and the respective auxiliary control units allow serial communication between the master control unit and the respective auxiliary control units over the communication timing cable 14, which may be up to 1.2 kilometers in length. Via the communication interfaces, the master control unit can instruct each auxiliary control unit to perform the various phases of the blasting procedure, that is, testing the number of detonators, programming the detonators, and initiating the detonators. The blast pattern table generated in the laptop computer 44 is transferred to each auxiliary control unit, and the status of each auxiliary control unit is monitored according to predetermined criteria. The serial number of the auxiliary control unit, which is a number in the range of 0 to 255, can be read, as can the number of detonators counted during testing of the system. Each auxiliary control unit also performs a full functional test on itself when it is powered up, by switching in dummy loads across its various output power supplies and signal lines to verify functioning.

The main or reference timing unit 42 of the master control unit generates a crystal controlled square wave of 1 Hz. This square wave serves as a master timing or master clock signal which is transmitted directly via the communication/timing cables 14 to the time synchronisation circuit of each auxiliary control unit 12. As described above, the time synchronization circuit locks the local square wave clock signal to the master square wave signal from the master control unit, with an accuracy of within 0.1 ms. The microprocessor 20 in the auxiliary control unit then uses this synchronised local clock signal as a timing reference when initiating its electronic delay detonators.

The local clock signal is used to control the timing of the initiation of the detonators connected to each auxiliary control unit so that they are initiated at the correct time with respect to the detonators connected to other auxiliary control units. Thus, the local clocks or timing signals generated by the respective auxiliary control units, which are used to control the timing of the initiation of the electronic delay detonators, are synchronised to an accuracy of at least 0.1 ms across the entire blasting zone.

Figure 4:
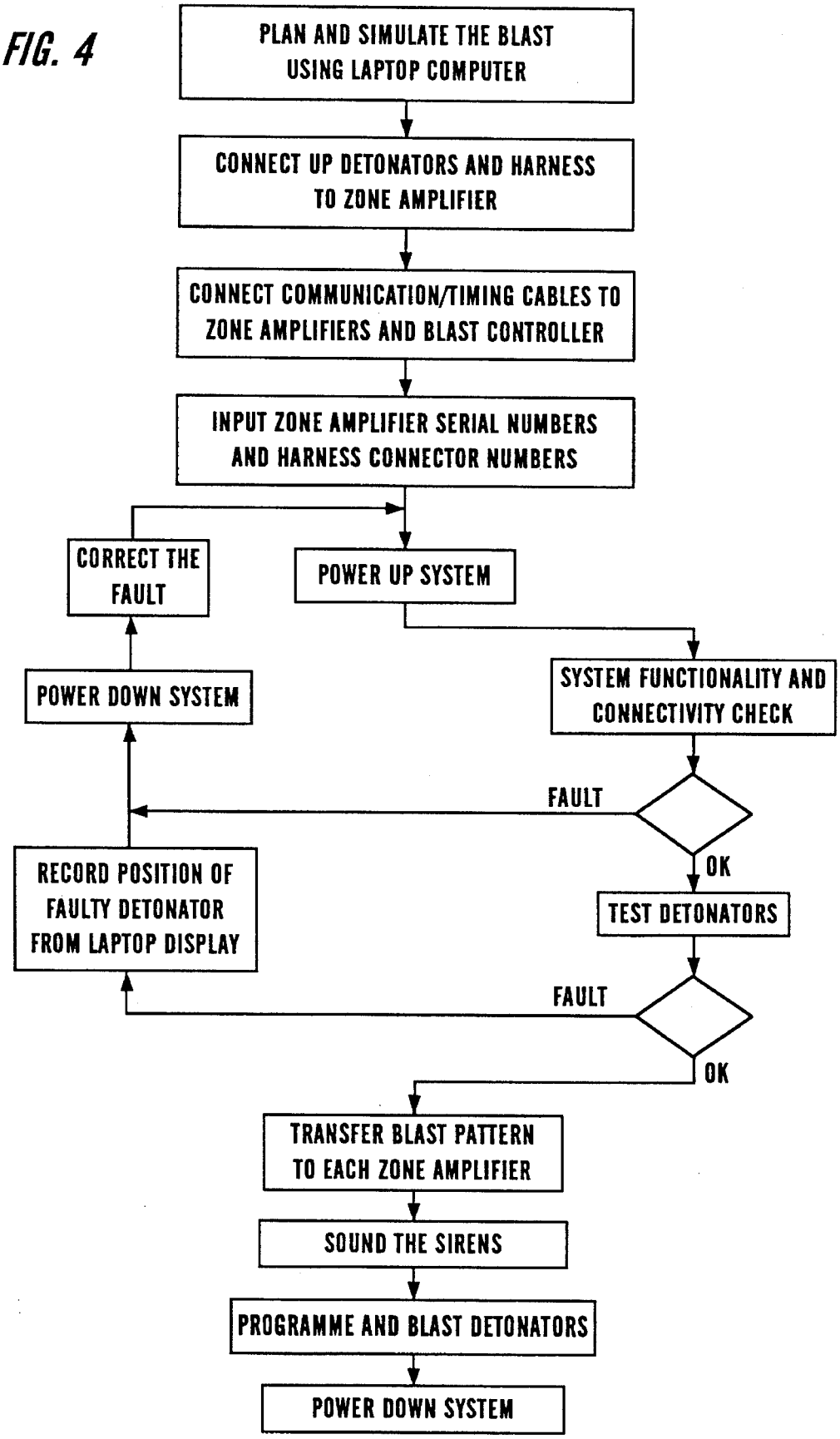
FIG. 4 is a simplified flow diagram illustrating the overall operation of the system.
Figure 5:
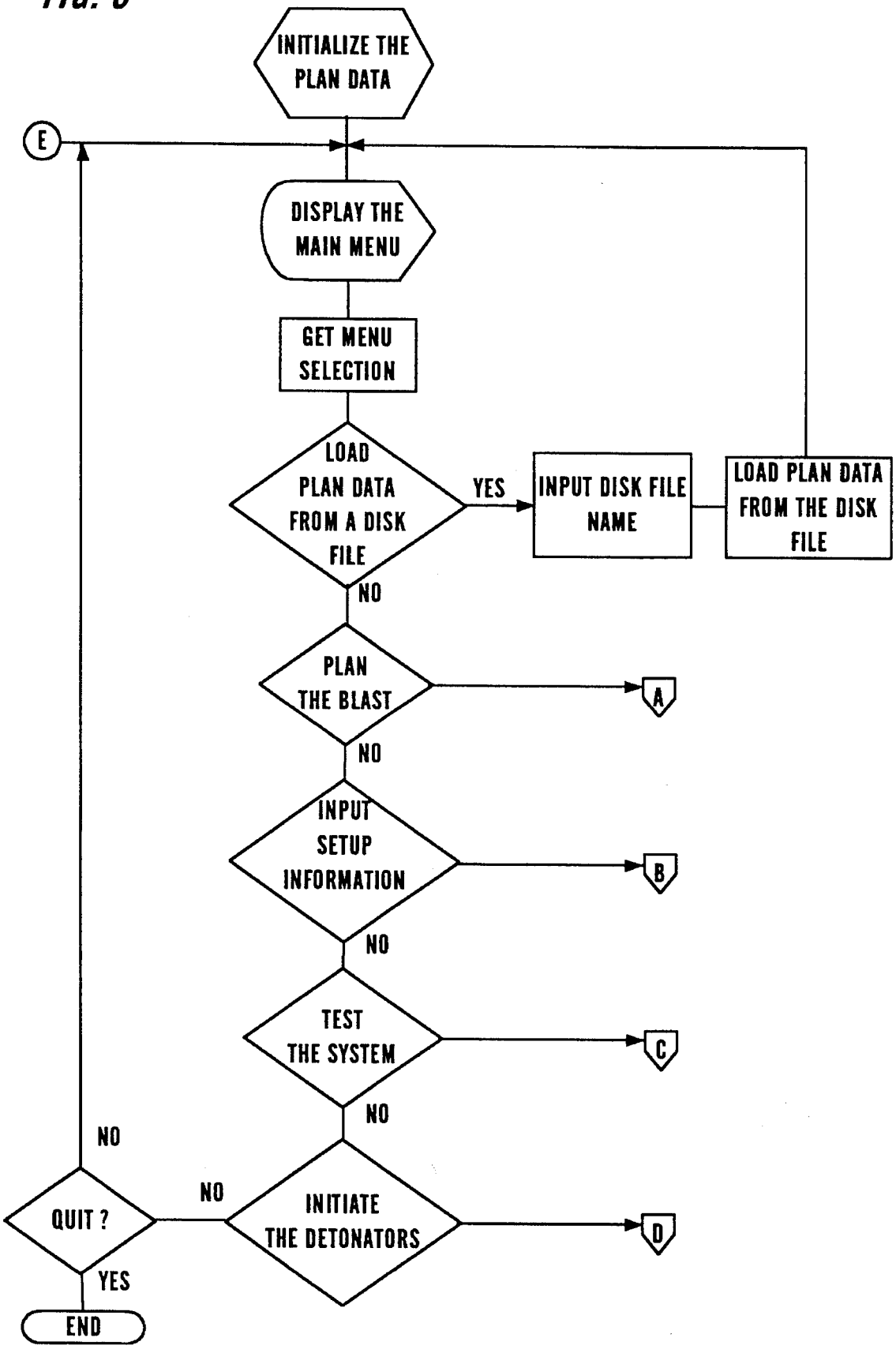
FIGS. 5 to 9 are flow diagrams illustrating different aspects of the operation of the system in more detail.
Figure 6A:
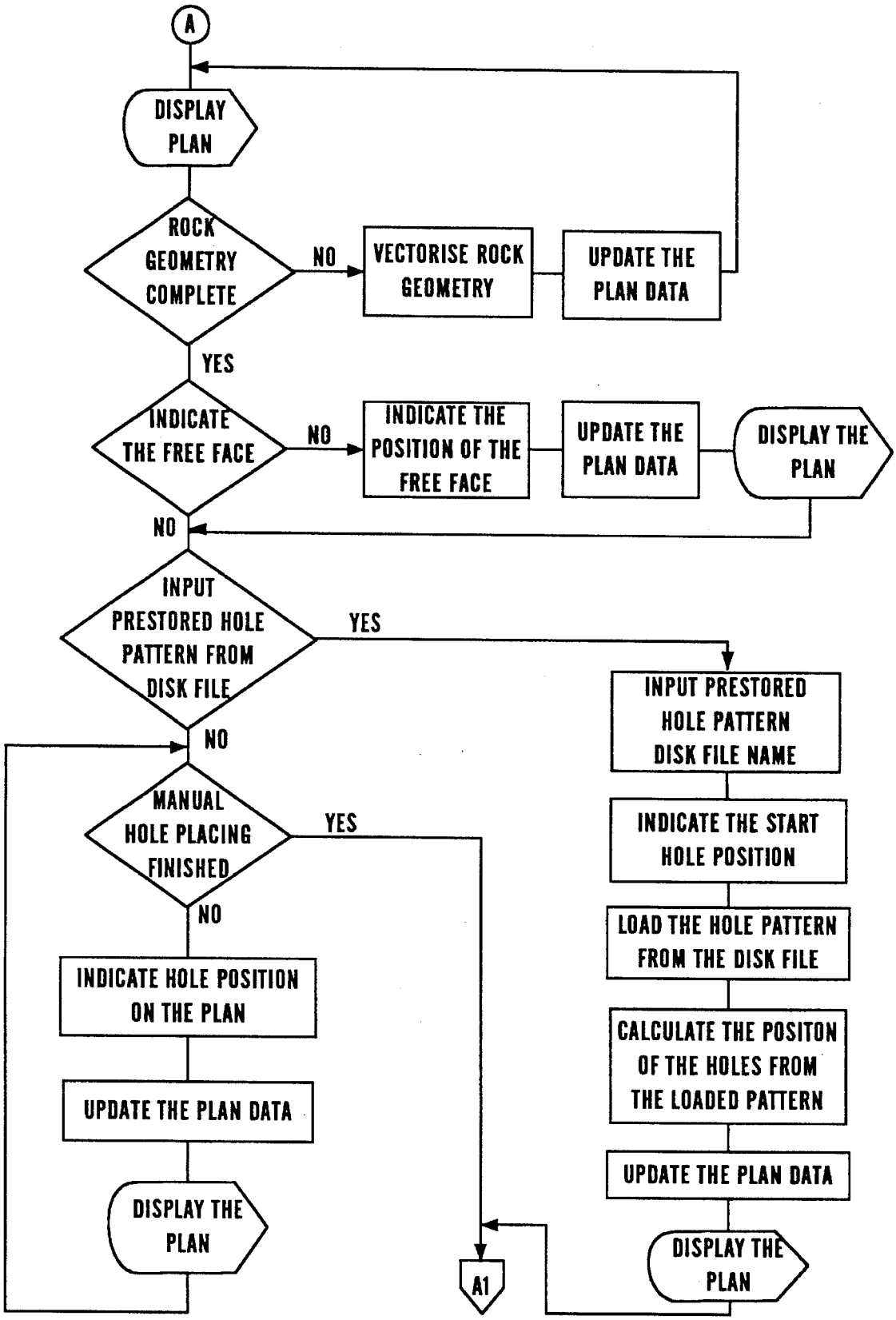
Figure 6B:
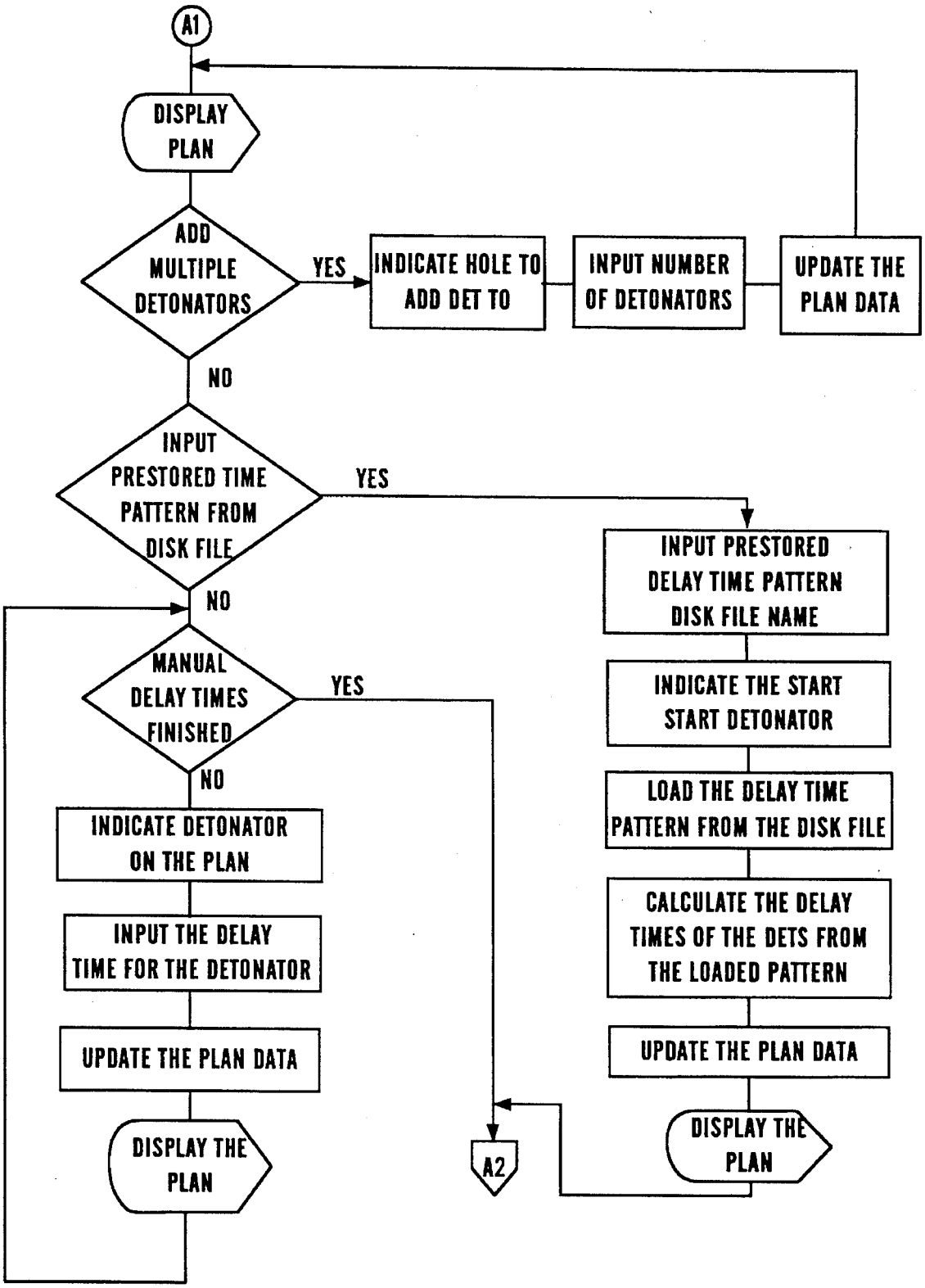
Figure 6C:
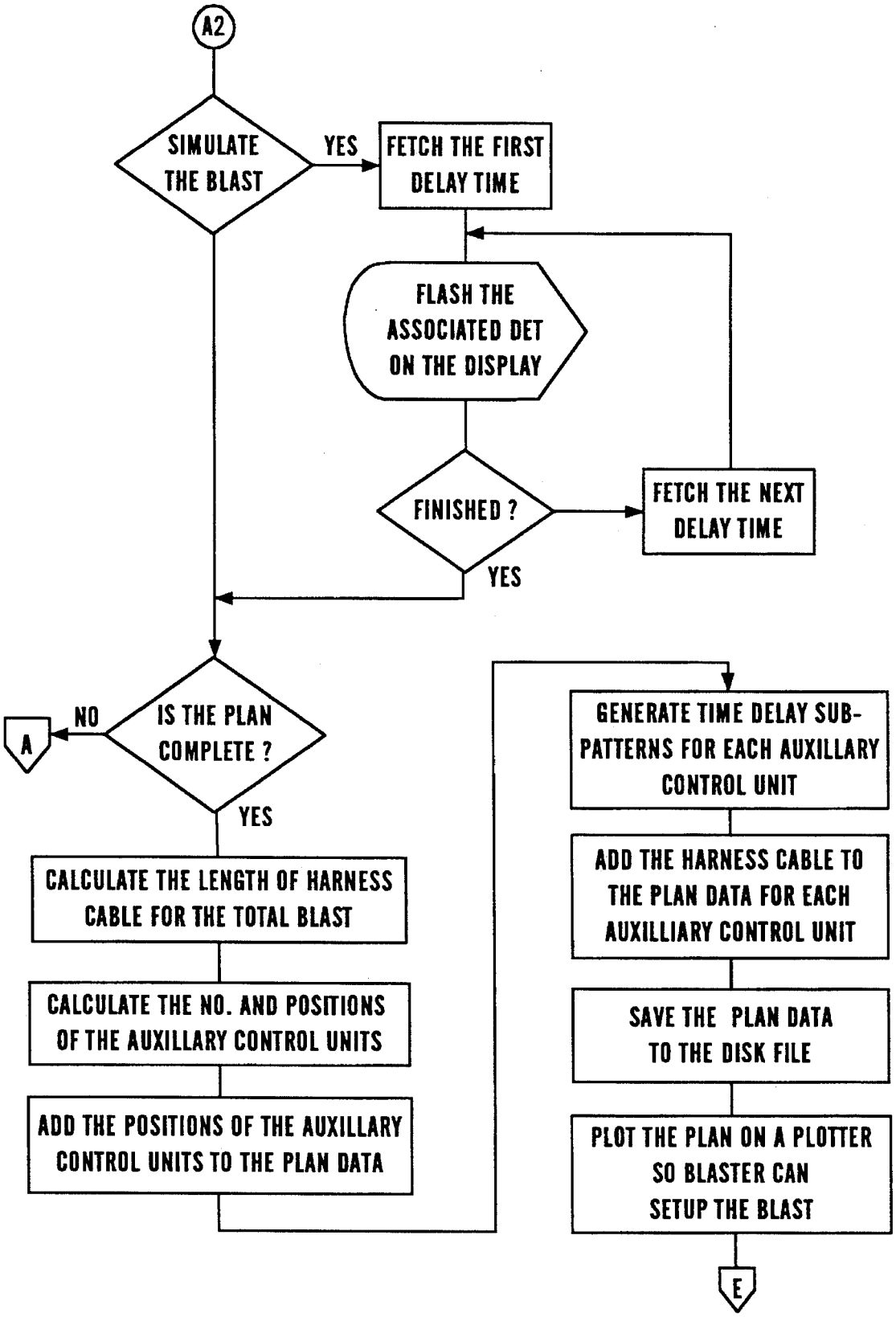
Figure 7:
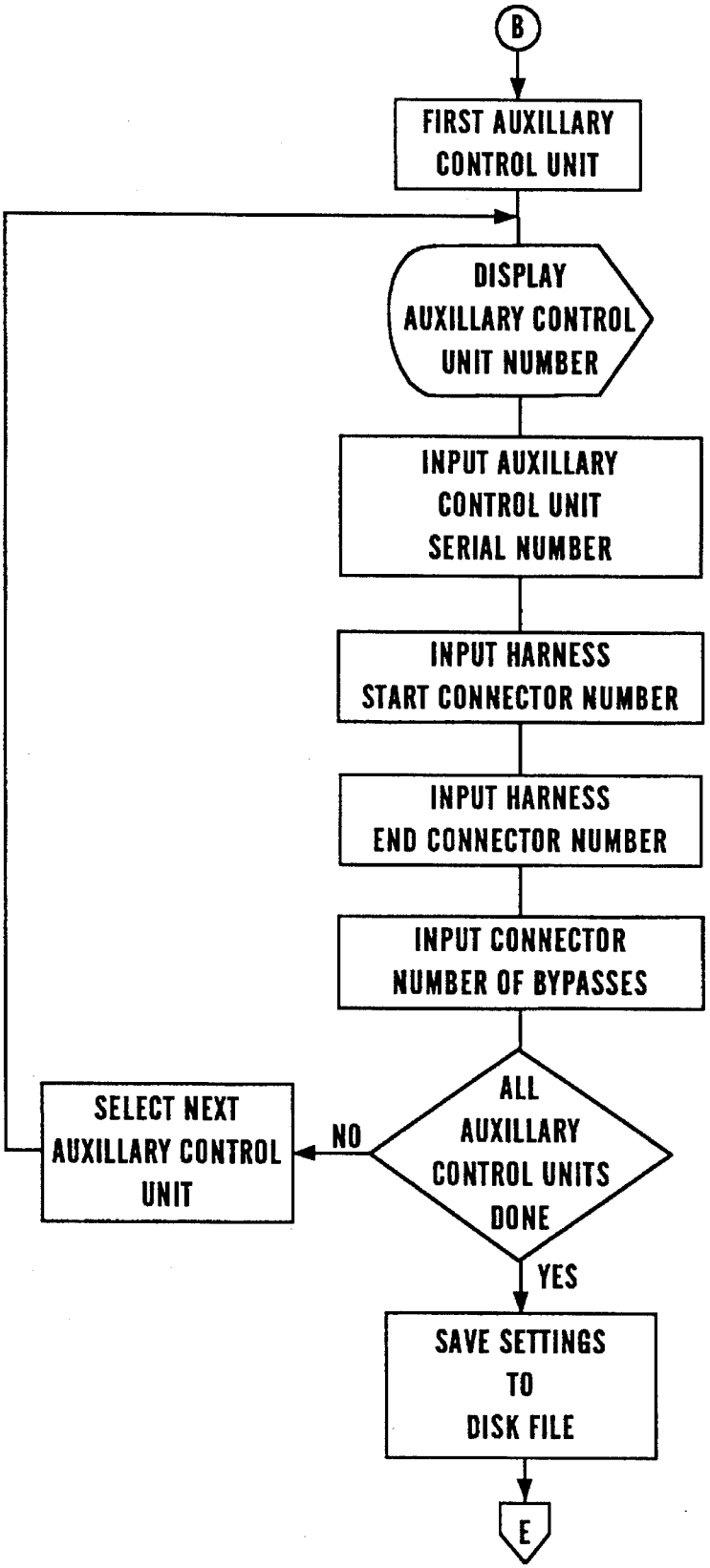
Figure 8:
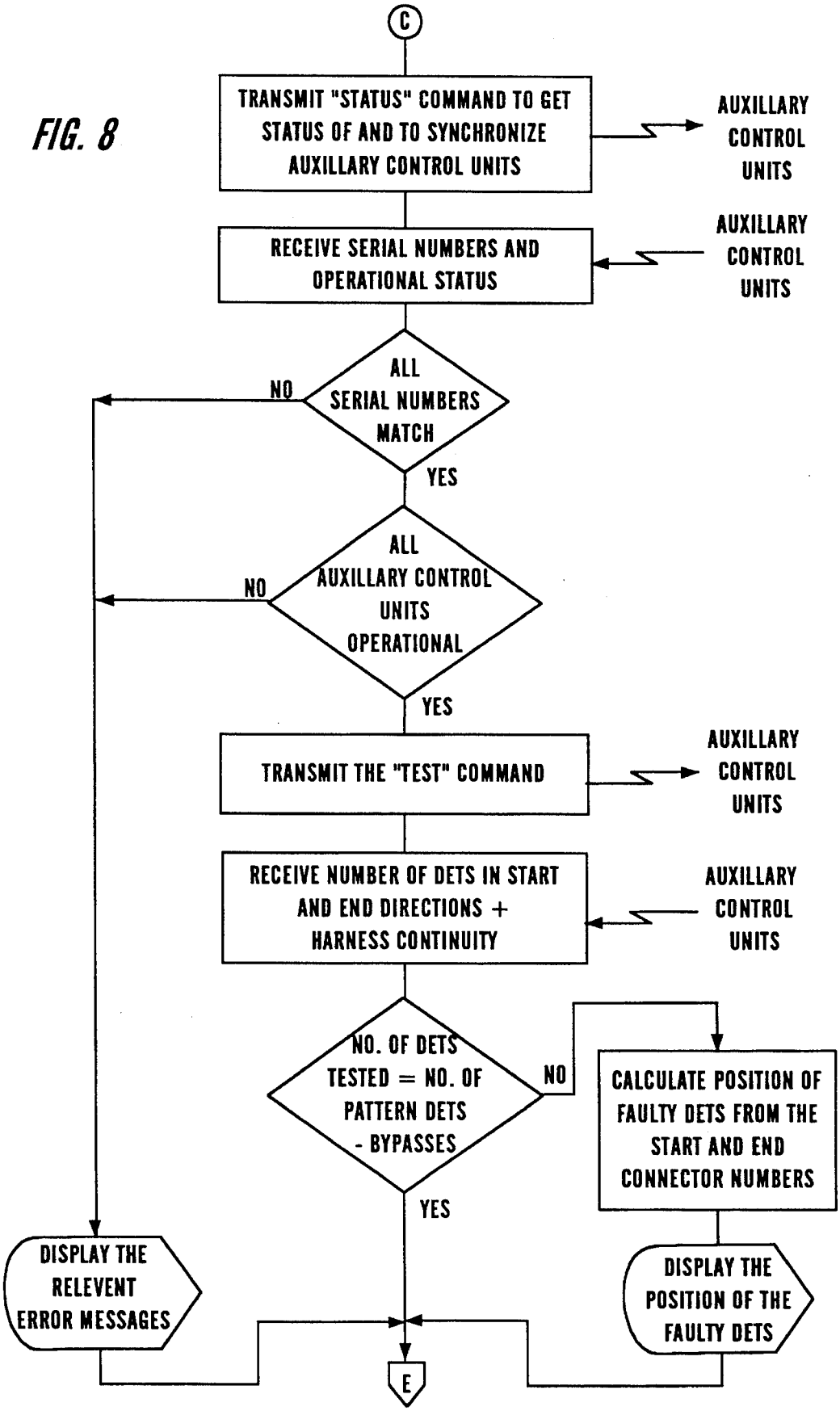
Figure 9:
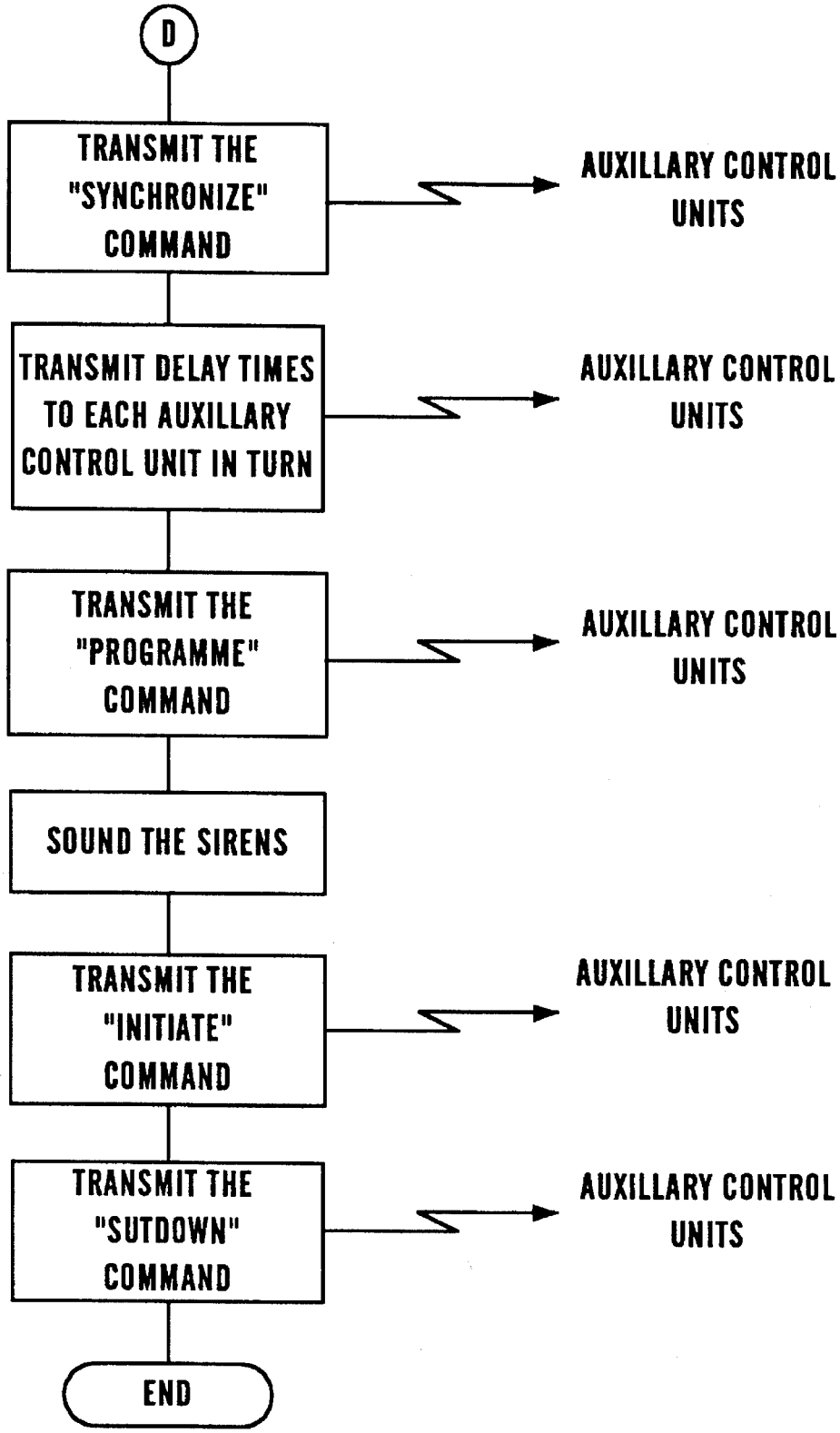

The flow diagram of FIG. 4 illustrates the general operation of the system, while the flow diagrams of FIGS. 5 to 9 illustrate different aspects of the operation of the software of the system in more detail. FIG. 5 is an overall operational flow diagram indicating the various operating modes of the blasting software. The diagrams of FIGS. *6a* to *6c* illustrate the blast pattern planning procedure which is carried out on the laptop computer 44 associated with the master control unit. The flow diagram of FIG. 7 illustrates the set-up procedure in which the auxiliary control unit serial numbers and harness connector numbers are entered for each auxiliary control unit. FIG. 8 shows the testing procedure controlled by the blasting software, and FIG. 9 shows the actual blasting or detonator initiation procedure.

Referring to FIGS. 5 and *6a* to *6c*, the sequence of operation of the system begins with the operator planning the blast using the laptop computer 44. The special purpose blast planning software has a graphical CAD-like interface. This allows the operator to graphically lay out the blast using a pointing device such as a mouse or a "roller ball". The operator begins by drawing in the geometry of the rock to be blasted, including specifying the free face (if there is a free face). The blast holes are then added, with a single detonator associated with each hole. This can either be done manually by positioning each hole one at a time, or automatically from a library of previously stored patterns. To assist in placing the holes accurately, grid lines and a ruler are provided. The spacing between grid lines can be specified and a "snap to grid" feature can be used when adding holes. The ruler is used for measuring the distance between two points on the plan. Additional information such as the hole diameter and hole depth is also associated with each hole.

Multiple detonators can be added to holes that require them. The holes are initially placed with single detonators, and additional detonators can then be added to them. Multiple detonators are used for redundancy or for decking. (Decking comprises breaking up the blast hole into vertical sections of explosives with each section being separated from the next by means of sand or air bags. Separate detonators with different delay times are placed in each section of explosives. This system might be used to blast a layer of coal out from underneath the overlying rock). The multiple detonators in a hole are indicated graphically on the blast plan.

Delay times are then added to the detonators. This can be done manually by selecting a detonator and then specifying the delay time for that detonator, or it can be done automatically from a previously stored timing pattern. Once all the times have been added the blast can be graphically simulated. This allows the operator to check that the order of initiation of the detonators and the delay timing of the detonators is acceptable. It is possible at this point to execute blast optimisation software. This software adjusts the planned delay times to give the best performance for a chosen parameter, for example, better rock fragmentation, reduced ground vibration or reduced air blast levels. The relevant criteria for each parameter are included in the software.

The above steps may have to be repeated a number of times until the operator is completely satisfied with the blast plan. Once the blast plan is complete, the software automatically places the required number of auxiliary control units on the plan, based on the predicted electrical performance of the length of cable and the number of detonators to be connected. Subpatterns with the relevant timing subpattern are generated for each auxiliary control unit used. Finally, layout instructions are generated for the blaster in charge of the blast. These can either be in the form of a tabulated set of instructions or in the form of a graphical plot of the blast layout.

From the layout instructions generated, the blaster connects up the blast. The detonators are placed in the blast holes with the bulk explosives. A harness cable is connected to each of the detonators in the zone of the relevant auxiliary control unit. The harness cable is manufactured in long rolls with a standard spacing between connectors (dependent on the mine's requirements). In use, a piece of cable is cut from the roll and used for the harness. Each of the connectors on the roll is numbered, for example, from 1 to 1000. The connector numbering allows checking that the correct number of detonators is connected to an auxiliary control unit for a specific zone and also enables the location of any faults to be indicated to the blaster.

The blaster can also plug a "bypass" into the harness connectors. A dummy plug or "bypass" bridges the signal lines of the connector that it is plugged into. A "bypass" would be used where a hole is indicated on the plan but the hole was not actually drilled, or where the cable connector spacing is not long enough to reach the next hole.

The harness is connected to the auxiliary control unit by means of two "lead ons". The "lead ons" plug into two detonator sockets on the harness cable. It is imperative that the order of connection is maintained i.e. that the start "lead on" is plugged into the start of the harness and that the end "lead on" is plugged into the end of the harness. Arrows indicating the start to end direction can be printed onto the harness connectors and onto the "lead on" connectors to aid the blaster. At the auxiliary control unit the ends of the "lead ons" can have differently shaped connectors to ensure the correct order of start and end is maintained.

The above steps are repeated for each of the auxiliary control units. The auxiliary control units are all connected to the master control unit. The master control unit can be up to 1200 meters from the auxiliary control units. Each of the auxiliary control units has a serial number, with the different auxiliary control units used in a particular blast having different serial numbers. The serial number enables the surface blasting system to check that the auxiliary control units have been connected to the main control unit in the correct order. The serial number is typically printed on the outside of the auxiliary control unit. Prior to the blaster beginning with the testing of the detonators, he must enter into the laptop computer the serial number of the auxiliary control units for each of the zones, the start and end harness connector numbers for each of the zones, and the connector numbers of any "bypasses" used (these numbers will be gathered by the blaster from inspection). The entering of this setup data is shown in FIG. 7.

Once the detonators have been connected to each auxiliary control unit by means of the harness, the detonators can be tested (see FIG. 8). The laptop computer 44 communicates with the auxiliary control units and checks that the serial numbers entered by the blaster are in fact correct. If not, an error is reported to the blaster. The software then operates to cause the auxiliary control units to be synchronised to a test master timing signal and instructs each auxiliary control unit to perform a functionality test on itself. This test includes testing of the signal lines and power supplies with dummy loads. Any faults are again reported to the blaster.

The software then instructs the auxiliary control units to perform a test on their respective attached detonators. Each of the auxiliary control units reports the number of detonators found and whether the attached harness is continuous from the start to end points. The software then compares the number of detonators found against the planned number of detonators, less the number of "bypasses". If these numbers do not match then a fault is indicated to the blaster. The indication of the fault can be shown graphically and can also be given as a connecter number with the respective auxiliary control units serial number. The connector number of the faulty detonator is calculated from the start and end connector numbers typed in by the blaster. If any faults are detected then the blaster is required to fix them using the information given to him by the software. Once the fault has been corrected then the above procedure is repeated until all the faults have been corrected. The system is now ready to initiate the detonators.

Referring now to FIG. 9, the software waits for the blaster to issue the instruction to blast. Once the blast instruction has been issued, then the auxiliary control units are synchronised to the master timing signals of the master control unit. The detonator delay times (or blast patterns) are transferred from the master control unit to the auxiliary control units, with each of the auxiliary control units receiving the respective delay times for its attached detonators. Each detonator attached to each auxiliary control unit is then programmed with its respective delay time and the sirens are sounded. The detonators are energised and then instructed to start their attached detonator timers using the synchronisation means. The entire system is then made safe and shut down.

Figure 10:
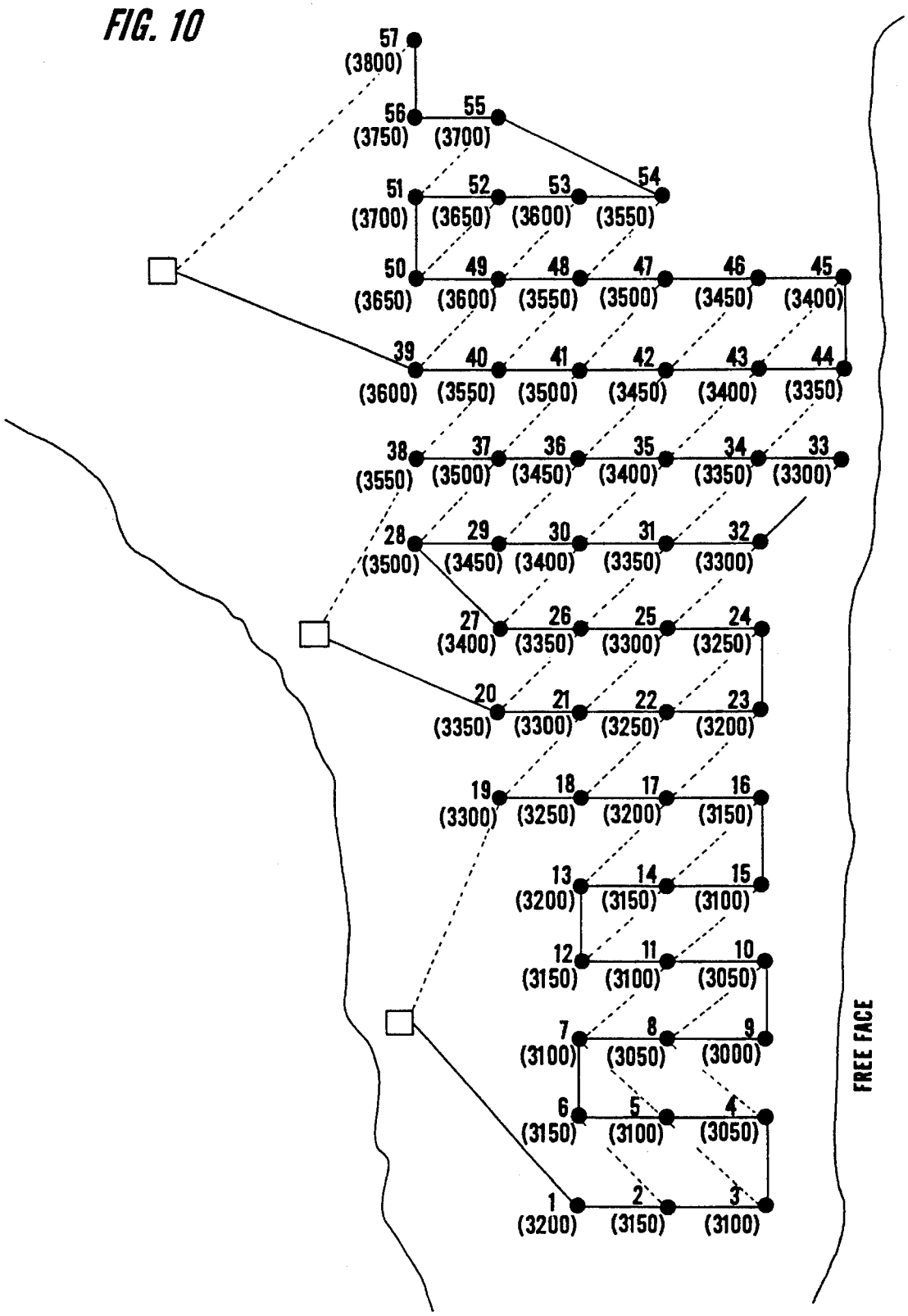
FIG. 10 is a diagrammatic illustration of a typical multi-zone blasting pattern.

A practical example of a blast pattern is shown in FIG. 10, with three different blast zones controlled by respective auxiliary control units 12. Each detonator in FIG. 10 is numbered and the figures in brackets indicate the delay time in milliseconds programmed into each detonator. The dotted lines indicate detonators which are timed to explode at the same time.

We claim:

1. Apparatus for activating a plurality of groups of electrical loads after respective predetermined time delays comprising a master control unit and a plurality of auxiliary control units each controlling a respective group of remote electrical delay devices which are associated with corresponding electrical loads, the master control unit comprising:

master processor means for generating master programming signals corresponding to an activation sequence for the electrical loads of each group of electrical loads, a plurality of communications interfaces for transmitting the master programming signals to respective ones of said plurality of auxiliary control units, reference timing means for generating a master timing signal for transmission to each auxiliary control unit, and control means for generating master control signals corresponding to an initiation instruction for initiating the electrical delay devices;

each auxiliary control unit being connectable to the master control unit and comprising:

local processor means responsive to the master programming signals to generate local programming signals therefrom for programming operation of the respective group of electrical delay devices in accordance with the activation sequence, synchronisation means for generating local timing signals in synchronisation with the master timing signal, local control means for generating local control signals from the master control signals which are synchronised with local control signals of other auxiliary control units for initiating operation of the electrical delay devices of the respective group of electrical loads so that the activation sequences of the electrical loads of each group of electrical loads are synchronised, and energisation means adapted to supply electrical power to the electrical delay devices and corresponding electrical loads.

2. Apparatus according to claim 1 wherein the electrical loads comprise electrically activated detonators, each associated with a corresponding one of said electrical delay devices.

3. Apparatus according to claim 2 wherein said master processor means further operates for generating a blast pattern by including in said master programming signals activation sequences for the detonators of each group of detonators.

4. Apparatus according to claim 1 wherein each auxiliary control unit includes an auxiliary communication interface for receiving the master control signals from said master control unit and for transmitting data representative of an operational state of the auxiliary control unit to said master control unit.

5. Apparatus according to claim 1 wherein the synchronisation means of each auxiliary control unit comprises a local oscillator for generating a primary local clock signal at a frequency higher than a frequency of the master timing signal, frequency adjustment means for incrementally increasing or decreasing the frequency of the primary local clock signal in response to correction signals, frequency divider means responsive to said frequency adjustment means for reducing the frequency of the primary local clock signal to a frequency close to the frequency of the master timing signal and outputting the primary local clock signal with the reduced frequency, and comparator means for comparing the output of the frequency divider with the master timing signal and for generating correction signals which are applied to the frequency adjustment means so that the output frequency of the frequency divider means approaches the frequency of the master timing signal.

6. Apparatus according to claim 5 wherein the frequency adjustment means comprises:

a multiplexer, a pulse adder circuit connected between the local oscillator and a first input of the multiplexer, and a pulse subtracter circuit connected between the local oscillator and a second input of the multiplexer, an output of the local oscillator being connected directly to a third input of said multiplexer, said multiplexer selecting one of the first, second and third inputs thereof in response to the correction signals to adjust incrementally the frequency of the primary local clock signal at an output of the multiplexer.

7. Apparatus according to claim 1 wherein the synchronisation means of each auxiliary control unit operates for generating the local timing signals, which have been synchronised with the master timing signal, independently of the master timing signal for a predetermined period prior to activation of the respective electrical loads.

8. Apparatus according to claim 1 wherein the master control unit is connected to receive data corresponding to the activation sequence for the loads of all of the groups of electrical loads from an auxiliary computer, and to transfer data corresponding to the activation sequence for the loads of each group of electrical loads to the respective auxiliary control unit.

9. Apparatus according to claim 8 wherein the master control unit is configured to receive data from each auxiliary control unit corresponding to an operational status thereof, and to transfer the received data to the auxiliary computer so that the status of each auxiliary control unit can be monitored centrally.

10. Apparatus according to claim 1 wherein said auxiliary control units operate independently of said master control unit and in synchronism therewith for generating said local programming signals programming operation of the respective group of electrical delay devices and said local control signals initiating operation of the electrical delay devices associated therewith.

11. Apparatus for activating a plurality of groups of electrical loads after respective predetermined time delays comprising:

a master control unit for generating master control signals corresponding to an initiation instruction for a plurality of electrical delay devices associated with respective loads of each group of electrical loads; and a plurality of auxiliary control units connectable to the master control unit and each adapted to control a respective group of remote electrical delay devices which are associated with corresponding electrical loads, each auxiliary control unit including local control means for generating local control signals from the master control signals which are synchronised with local control signals of other auxiliary control units, for initiating operation of the electrical delay devices of the respective group of electrical loads, and energisation means adapted to supply electrical power to the electrical delay devices and corresponding electrical loads, wherein the master control unit is adapted to generate a master timing signal and to transmit the master timing signal to each auxiliary control unit, each auxiliary control unit including synchronisation means for generating local timing signals in synchronisation with the master timing signal, the local control signals of each auxiliary control unit being generated synchronously with the respective local timing signals.

12. A method of activating a plurality of groups of electrical loads, each having an associated electrical delay device, after respective predetermined time delays, the method comprising:

transmitting master programming signals corresponding to an activation sequence for the electrical loads of each group of electrical loads from a master control unit to each of a plurality of auxiliary control units;

generating local programming signals at each auxiliary control unit from the master programming signals and transmitting the local programming signals to the electrical delay devices of the respective groups of electrical loads, thereby to program operation of each electrical delay device and its associated load;

generating master control signals at the master control unit corresponding to an initiation instruction for the electrical delay devices associated with the respective loads of each group of electrical loads, and transmitting respective master control signals to each auxiliary control unit;

generating master timing signals at the master control unit, and transmitting the master timing signals to each auxiliary control unit;

generating local control signals at each auxiliary control unit from the master control signals and the master timing signals, the local control signals of each auxiliary control unit being synchronised with one another, for initiating operation of the electrical delay devices of the respective group of electrical loads; and energising the delay devices and their associated loads to activate the loads so that the activation sequences of the electrical loads of each group of electrical loads are synchronised.

13. A method according to claim 12 wherein said step of generating local control signals further comprises generating local timing signals at each of the auxiliary control units which are synchronized with the local timing signals of other auxiliary control units, and generating the local control signals synchronously with the respective local timing signals.

14. A method according to claim 12 wherein the master programming signals are generated in accordance with a predetermined blast pattern which is configured on a computer.

15. A method according to claim 14 including the further step of laying out the blast pattern graphically on a display of the computer.

16. A method according to claim 12 including the step of programming each delay device with a respective delay time.

17. A method according to claim 16 wherein said step of programming each delay device comprises automatically programming the delay times for respective delay devices by using a stored timing pattern.

18. A method according to claim 16 comprising the further step of adjusting the programmed delay times in accordance with a chosen blast parameter to optimise that parameter.

19. A method according to claim 18 wherein the chosen blast parameter is related to at least one of optical rock fragmentation, reduced ground vibration, and reduced air blast levels.

20. A method according to claim 12 wherein the master programming signals transmitted to respective different auxiliary control units contain information which is adapted to respective blasting zones.

* * * * *